US005445534A

United States Patent [19]

Ishizuka et al.

[11] Patent Number: 5,445,534

[45] Date of Patent: Aug. 29, 1995

[54] DOUBLE LOCK MALE/FEMALE TYPE CONNECTOR

[75] Inventors: Hironori Ishizuka; Wataru Maruoka; Arifumi Tomikawa, all of Kanagawa, Japan

[73] Assignee: Oki Densen Kabushiki Kaisha, Japan

[21] Appl. No.: 127,595

[22] Filed: Sep. 28, 1993

Related U.S. Application Data

[60] Division of Ser. No. 80,450, Jun. 21, 1993, abandoned, which is a continuation of Ser. No. 681,745, Apr. 8, 1991, abandoned.

[30] Foreign Application Priority Data

| | | | |
|---|---|---|---|
| Apr. 13, 1990 | [JP] | Japan | 2-39595 U |
| Apr. 13, 1990 | [JP] | Japan | 2-39596 U |
| Jul. 4, 1990 | [JP] | Japan | 2-71303 U |

[51] Int. Cl.[6] ..... H01R 13/627

[52] U.S. Cl. ..... 439/352; 439/610

[58] Field of Search ..... 439/350, 352, 353, 354, 439/357, 358, 347, 607, 609, 610

[56] References Cited

U.S. PATENT DOCUMENTS

| | | | |
|---|---|---|---|
| 4,457,575 | 7/1984 | Davis et al. | 439/610 |
| 4,577,920 | 3/1986 | Coldren et al. | 439/607 |
| 4,695,112 | 9/1987 | Maston et al. | 439/350 |
| 4,781,623 | 11/1988 | Philippson et al. | 439/610 |
| 4,838,811 | 6/1989 | Nakamura et al. | 439/610 |

*Primary Examiner*—Neil Abrams
*Assistant Examiner*—Hien D. Vu
*Attorney, Agent, or Firm*—Ronald P. Kananen

[57] ABSTRACT

In order to securely lock a male component in a female housing, a slidable member is provided on the male component and can be slid into a position wherein flexible arms on which a lock pawl or pawls are provided cannot flex to the degree that the pawls can disengage from the female housing. To reduce the overall height of the female housing, a rib is provided which extends into the mouth of the female housing and which is receivable in a slot formed in the leading edge of the male component. To shut out electromagnetic noise, metallic cover members are formed on the female housing and male component and arranged to electrically contact one another when the male component is inserted into the female housing. The metallic cover on the female housing is grounded.

8 Claims, 10 Drawing Sheets

DOUBLE LOCK MALE/FEMALE TYPE CONNECTOR

This application is a continuation of application Ser. No. 08/080,450, filed Jun. 21, 1993, now abandoned, which is a continuation of application Ser. No. 07/681,745, filed Apr. 8, 1991, now abandoned.

BACKGROUND OF THE INVENTION

1. Field of the Invention

The present invention relates generally to a connector for use with telephones, computers, computer disc drives, and the like type of electronic apparatus, and more specifically to an improved type connector which enables double locking, reduced thickness of the female housing, increased resistance to electromagnetic noise and simple construction.

2. Description of the Prior Art

Miniature type modular male/female type connectors offer various merits and have found use in telephone connections and the like. However, in the case of vehicular telephones, the construction illustrated in FIG. 1 has exhibited the drawback that a lock lever L/L on the male member sometimes cones out of engagement with the corresponding structure in the female housing when subject to external forces and vibration and thus does not not exhibit the required level of reliability.

FIG. 2 shows a second type of prior art connector. This type of so called EMI type connector enables a higher number of connections to be established and which is able to shut out electromagnetic wave noise. However, with this type of connector, in order to avoid the shape of the female housing becoming irregular, the thickness of the same met be increased.

JP-A-59-198675 discloses a connector construction of the above mentioned nature. However, this type of connector features a very large number of components and thus tends to be excessively costly.

SUMMARY OF THE INVENTION

It is an object of the present invention to provide an EMI type male/female type connector which has a simple inexpensive construction and which enables at least one of double locking, reduced thickness of the female housing, and increased resistance to electromagnetic noise.

In brief, the above object is achieved by an arrangement wherein in order to securely lock a male component in a female housing, a slidable member is provided on the male component and can be slid into a position wherein flexible arms on which a lock pawl or pawls are provided cannot flex to the degree that the pawls can disengage from the female housing. To reduce the overall height of the female housing, a rib is provided which extends into the mouth of the female housing and which is receivable in a slot formed in the leading edge of the male component. To shut out electromagnetic noise, metallic cover members are formed on the female housing and male component and arranged to electrically contact one another when the male component is inserted into the female housing. The metallic cover on the female housing is grounded.

More specifically, a first aspect of the present invention is provided in a connector which features: a male component; a female housing into which the male component is insertable; a resilient member on the male component; a first pawl on the resilient member for engagement with the female housing; a slide member which is slidably mounted on the male component and arranged to move to a locking position wherein movement of the resilient member in a direction required for the detachment of the first pawl from the female housing is prevented.

A further aspect of the present invention is provided in a connector which features: a male component; a female housing into which the male component is insertable; a resilient member on the male component; lock means for securing the male component in the female housing; a rib formed in the female housing which extends into the opening through which the male component is inserted into the female housing; and a slot formed in the leading edge of the male component for receiving the rib.

A third aspect of the present invention is provided in a connector which features: a male component; a female housing into which the male component is insertable; a resilient member on the male component; lock means for securing the male component in the female housing; a first pressed metallic cover which is disposed in the mouth of the female housing through which the male component is inserted, the first cover being adapted to be electrically grounded; and a second pressed metallic cover which is disposed about the male component, the second cover engaging the first cover when the male component is inserted into the mouth of the female housing.

DETAILED DESCRIPTION OF THE PREFERRED EMBODIMENTS

Figure 1:
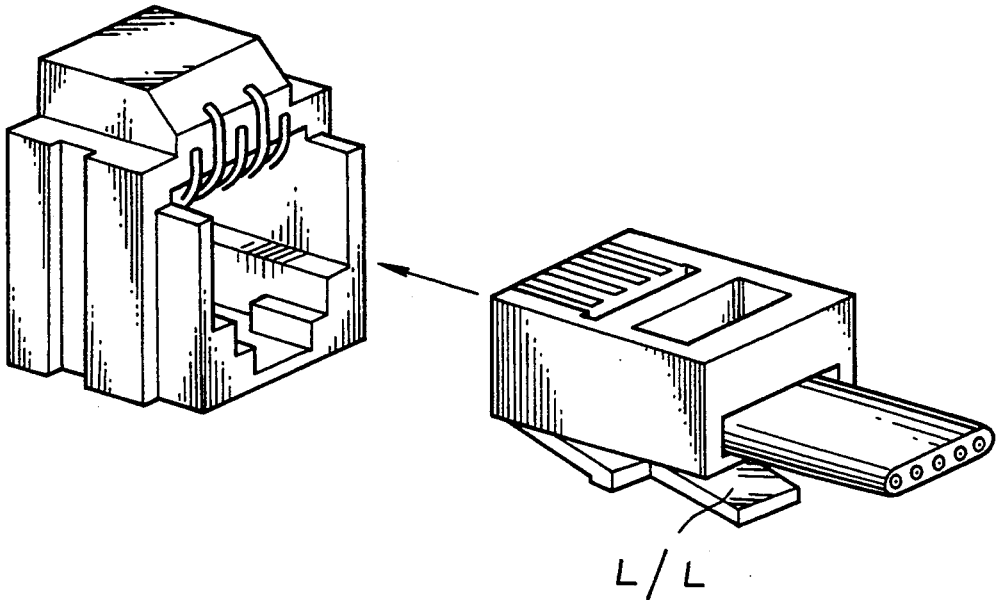
FIG. 1 (PRIOR ART)
FIGS. 1 and 2 are perspective views showing the prior art male/female type miniature connectors discussed in the opening paragraphs of the instant disclosure.
Figure 2:
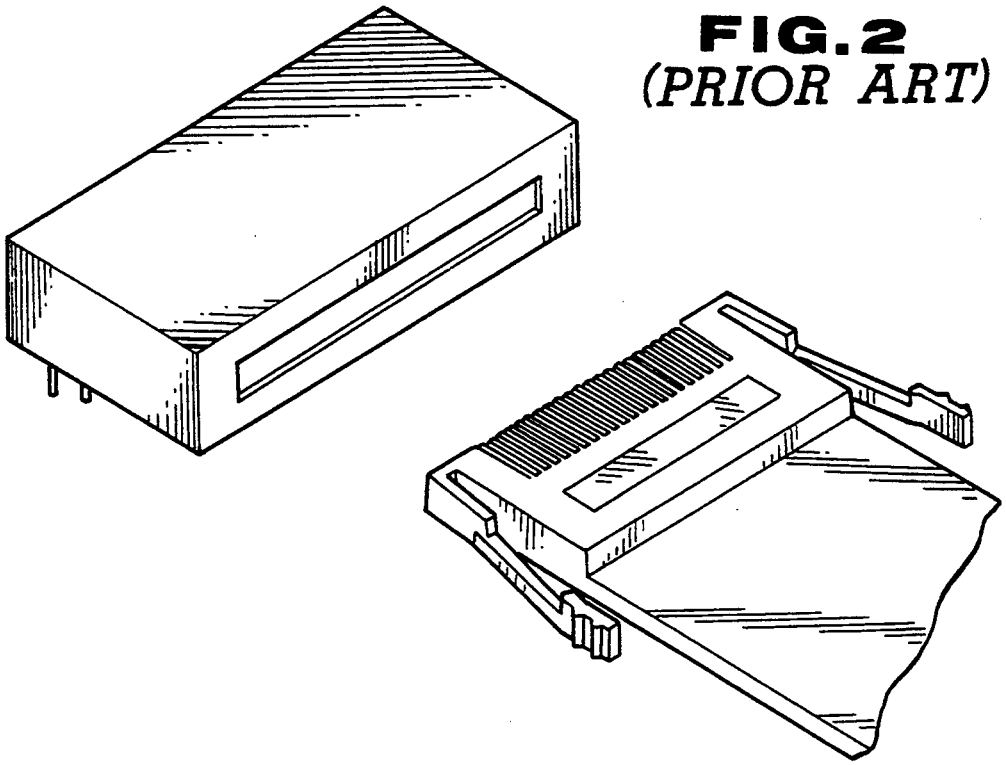
FIG. 2 (PRIOR ART)
Figure 3:
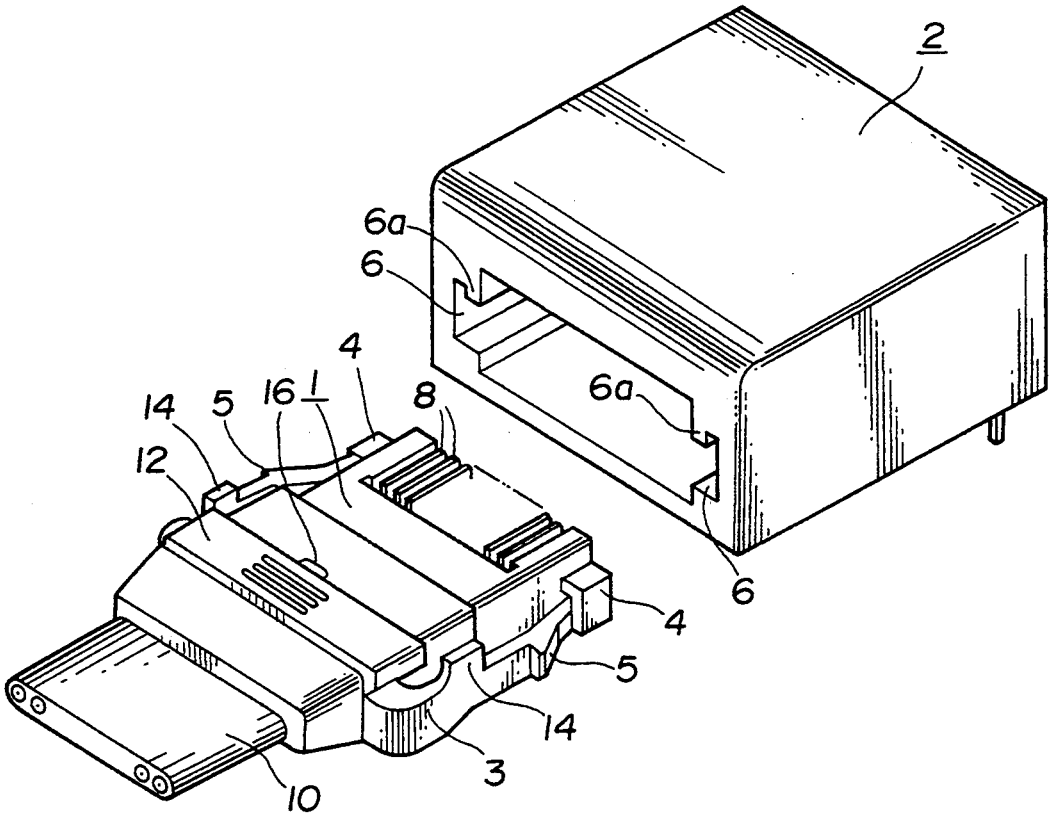
FIG. 3 is a perspective view showing a male/female type connector according to a first embodiment of the present invention.

FIG. 3 shows a first embodiment wherein the male component 1 is oriented for insertion into the female housing 2. The male component 1 is formed of a suitable synthetic resin and includes a pair of resilient lock levers 3 which are formed integrally with the main body of the male component 1 and which define a vital part of a first lock mechanism via which the male component is secured in place in the female housing 2. In this embodiment, the lock levers 3 originate near the rear end of the main body and extend toward the forward end wherein they are tucked into recesses defined by block-like guide projections 4. First laterally extending lock pawls 5 extend outwardly from the lock levers 3 to a level which is outboard of the side faces of the guide projections 4 (as they will be referred to hereinafter). The female housing 2 is formed with guide slots 6 which are dimensioned to slidably receive the guide projections 4. These guide slots 6 are suitably recessed (not shown) in a manner to lockingly receive the outwardly or laterally extending pawls 5 upon the male component 1 being sufficiently inserted into the female housing 2.

A plurality of vertical plate-like electrodes 8 are arranged across the leading edge of the male component 1. These plate-like electrodes 8 are electrically connected with wires contained in a flat cable 10.

A second lock mechanism comprises a slidable lock member 12 which extends laterally across the upper side of the male component 1 in the illustrated manner, and second lock pawls 14 which extend upwardly from the lock levers 3 at a location aft of the outwardly or laterally extending lock pawls 5. The slidable lock member 12 is arranged so that when is slid forward into an operative position, the side edges thereof juxtapose the inboard surfaces of the vertically extending lock pawls 14.

The underside of the slidable lock member 12 is suitably recessed in a manner to cooperate with projections 16 and 18 formed on the upper surface (projection 9 is shown in broken line in FIG. 5) in a manner to define a two position detente type mechanism.

Figure 6:
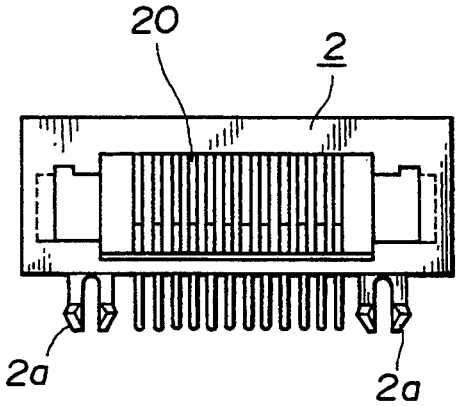
FIGS. 6 and 7 are front and side elevations showing the disposition of the connection pins which form part of the female component of the first and second embodiments.
Figure 7:
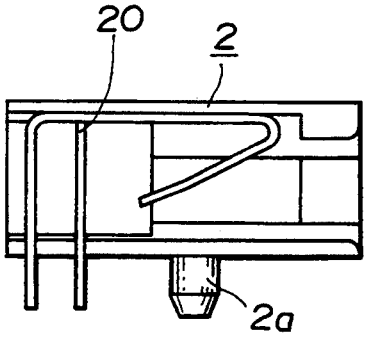

A plurality of wires are disposed within the female housing 2 in the manner illustrated in FIGS. 6 and 7. The inboard ends of the wires are bent and inserted into place in a manner which suitably maintains the vertically extending end portions in position to act as electrodes 20 which electrically engage the side surfaces of the vertically extending plate-like electrodes 8.

The lower surface of the female housing 2 is formed with downwardly extending fingers 2*a* which are adapted to be inserted into suitable recesses and retain the housing 2 in a preselected position.

With the above construction, when the male component 1 is inserted into the female housing 2, the outwardly extending pawls 5 engage the side walls of the guide slots 6 and deflect the resilient lock levers 3 inwardly. This deflection may be supplemented by manual compression. Under these conditions, the vertically extending lock pawls 14 pass inboard of the upper side walls 6*a* of the guide slots 6. Upon being inserted sufficiently, the outwardly extending lock pawls 5 enter the above mentioned recess. At this time the vertically extending lock pawls 14 enter a recess formed in the upper side walls 6*a*. Following this, the slidable lock member 12 is manually induced to slide forward until it engages on the forward projection 16. In this position the slidable lock member 12 prevents the vertically extending lock pawls 14 from escaping from the recess in which they are received. Thus, the male and female members are locked together both by the outwardly or laterally extending pawls 5 engaging in suitable recesses and by the engagement between the vertical pawls 14 and their corresponding recesses.

When it is desired to disengage the connection, the slidable lock member 12 is manually tracted until it engages the rear projection 18 and the lock lever 3 is manually pressed inwardly to bring the lateral and vertical pawls 5, 14 out of engagement with their respective recesses.

It should be noted that, in the first embodiment the guide projections 4 can be dispensed with if so desired.

Figure 4:
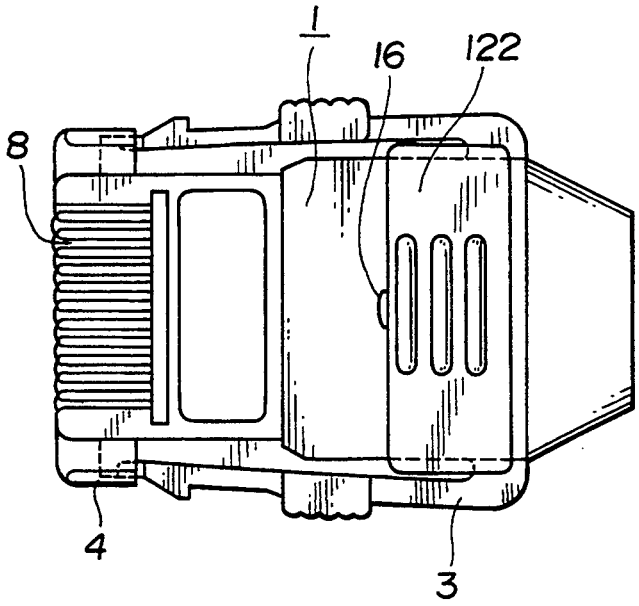
FIGS. 4 and 5 are plan and elevation view of the male component according to a second embodiment of the invention.
Figure 5:
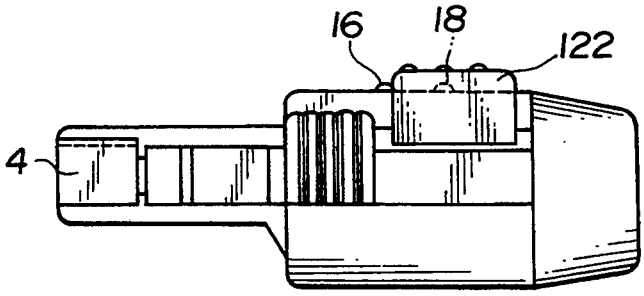

FIGS. 4 and 5 show a second embodiment of the present invention. This embodiment is basically similar to the first one and differs in that the vertically extending pawls are dispensed with and the slidable lock member 122 is arranged to be forwardly slidable to a position wherein the lock levers 3 cannot deflect inwardly. This of course securely prevents the outwardly extending pawls from accidently escaping from the recesses.

Of course the construction and arrangement of the guide slots 6 formed in the female housing 2 are slightly modified in this embodiments, however, this modification is deemed to lie fully within the grasp of one skilled in the art of electrical connectors and as such no further disclosure will be given for brevity.

Figure 8:
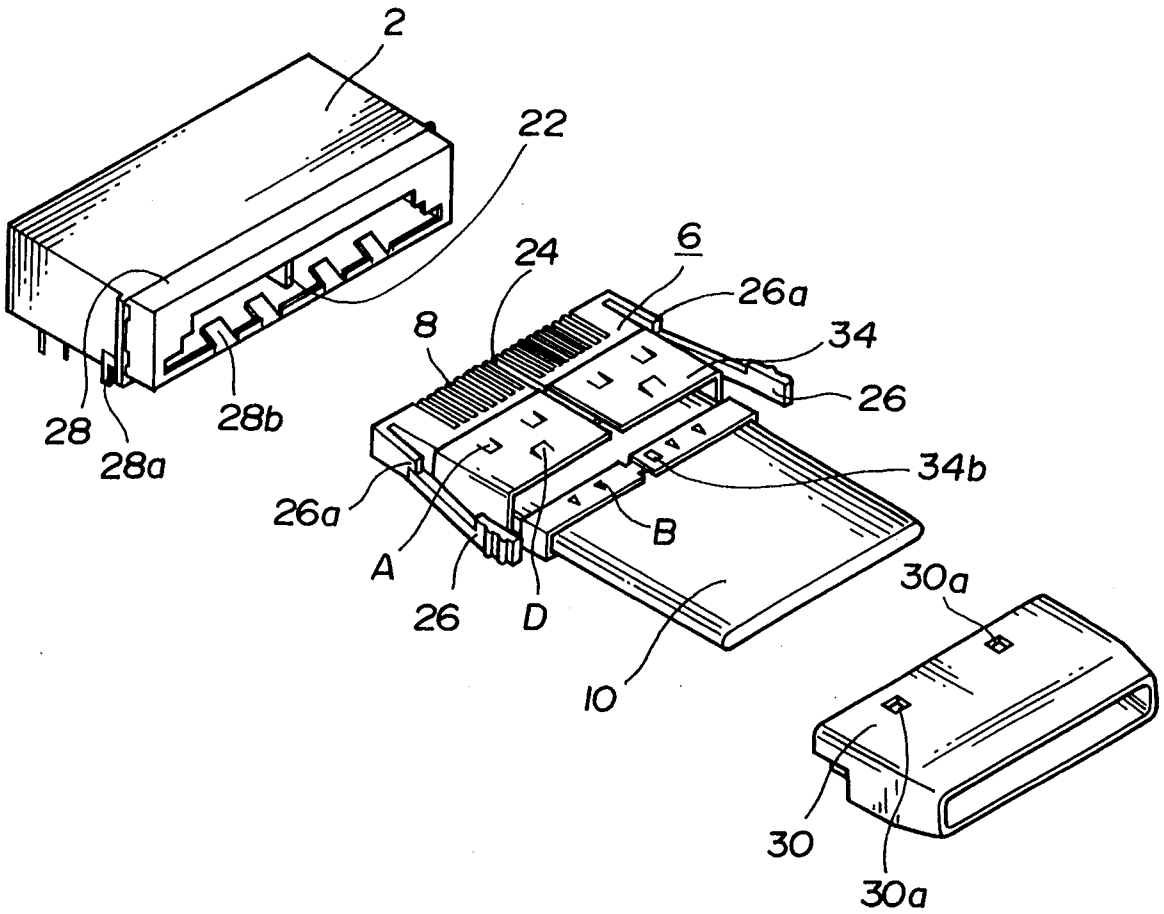
FIG. 8 is a perspective exploded view showing a construction which characterizes further embodiments of the present invention.
Figure 9:
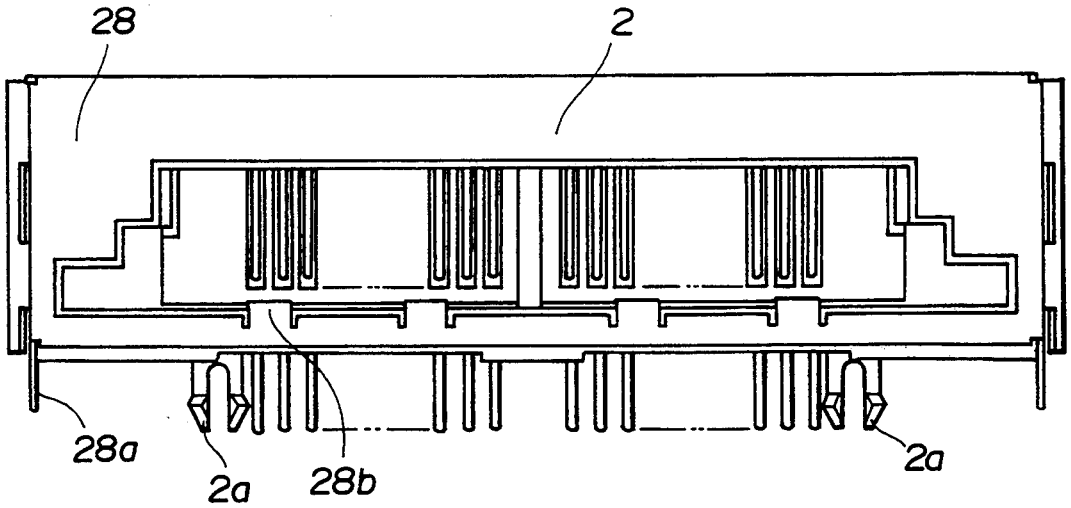
FIGS. 9–11 are front elevation, plan and side elevational views of the female member shown in FIG. 8.
Figure 10:
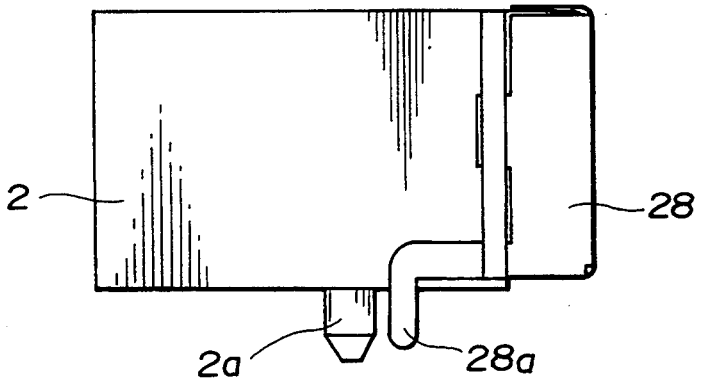
Figure 11:
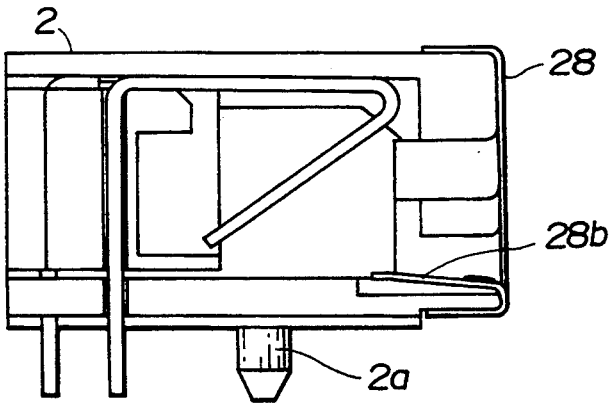

FIG. 8 shows a construction with embodies a number of inventive features. One of the major features of this construction comes in that the female housing 2 is formed with vertically extending rib 22 which in this case is arranged to descend downwardly from the upper edge of the mouth through which the male component is insertable, and further in that the male component is formed with a corresponding guide slot 24 in which the rib can be guidingly received.

This arrangement allows the thickness of the female housing 2 to be reduced by about half of the prior art arrangements.

Figure 19:
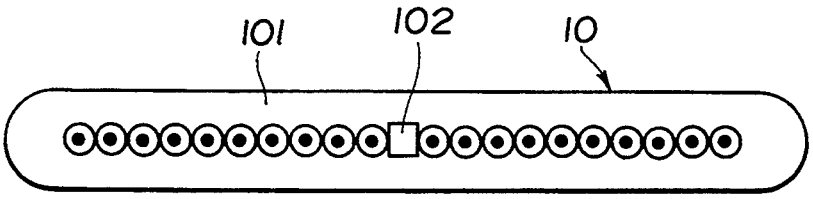
FIG. 19 is a sectional view showing constructional features of a flat sheath type flat cable used with the embodiments of the invention.

In more detail, the male component is formed with two lateral lock levers 26 which extend from the forward end of the member and which extend back toward the flat cable 10. The flat cable 10 in this embodiment is enclosed in a sheath 101 of PVC or the like and formed with a hollow bridge portion 102 in the manner shown in FIG. 19 so as to separate the wires into two sets. This allows room for the rib 22. The lock levers 26 are formed with vertically extending shoulder portions 26*a* which are engageable with the stepped side edge portions of a metallic cover 28 which forms part of the female housing 2. Further mention of the construction and effect of this component will be given later.

A cap 30 is arranged to slide over and enclose most of the rear portion of the male component and to be formed with recesses 30*a* into which angled barb-like projections are receivable in a manner which locks the main body of the male component and the cap 30 together.

Figure 14:
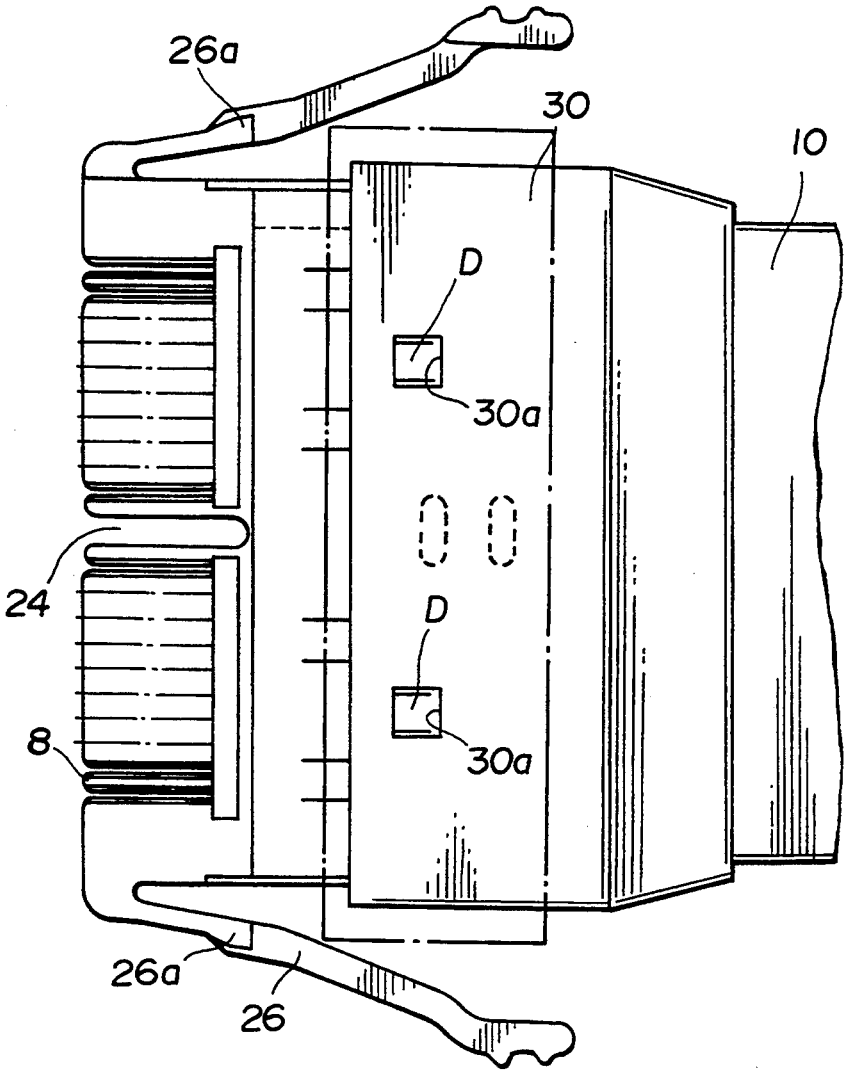
FIGS. 14 and 15 are plan and elevational views of the fully assembled male component shown in FIG. 8.
Figure 15:
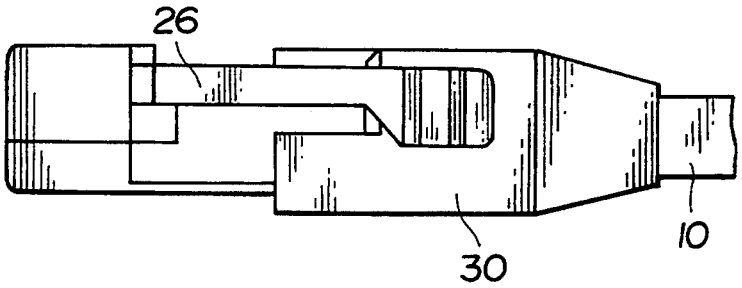

As shown in single dot phantom in FIG. 14, it is possible to provide the cap 30 with a slidable lock member of the nature disclosed in connection with the embodiment shown in FIGS. 4 and 5, and thus enable the lock levers 26 to be locked out against inward movement. This of course prevents accidental disconnection in the same manner as described previously.

It should be noted at this point that although the embodiment is illustrated with a rib 22 formed on the female housing 1, the invention is not limited to the same and it is possible to form the rib or ribs on the male component if so desired. Additionally, the use of cables other than the flat one described (with or without the spacing bridge portion 102) in possible and arrangements wherein the wires are arranged in different layers rather in two side by side flat groups is also within the scope of the invention.

Figure 12:
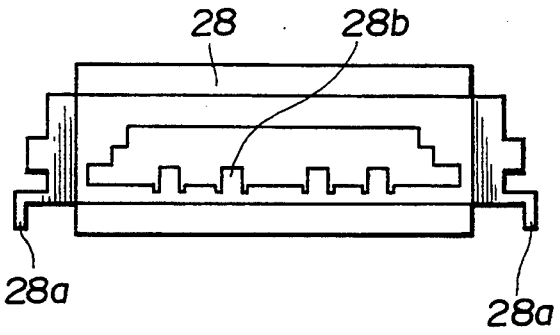
FIGS. 12 and 13 are front elevation and perspective view showing the constructional detail of a front panel or front cover arrangement which forms part of the female member shown in FIG. 8.
Figure 13:
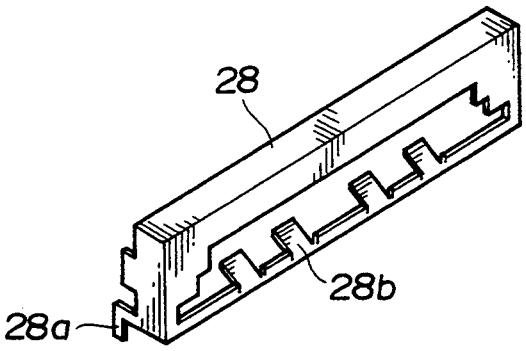
Figure 16:
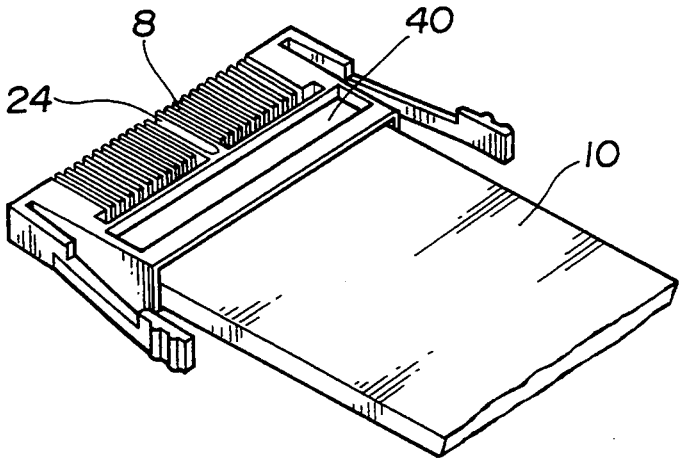
FIG. 16 is a perspective view showing the male member with a metallic cover member removed.

Further features of the arrangement disclosed in FIG. 8 are provided in that a front of the female housing is defined by the metallic member 28 which is produced by press forming and folding in the manner show in FIGS. 12 and 13. Viz., FIG. 12 shows a blanked out member ready for bending into shape. FIG. 13 on the other hand, shows the finished component. At this point it is worth noting that the front cover 28, as it will be referred to, is formed with two downwardly extending legs 28*a*. These legs 28*a* serve to establish an electrical grounding contact with some suitable member. The front cover 28 is also formed in a manner to define inwardly angled teeth-like projections 28*b*. The purpose of these projections 28*b* is to establish an electrical connection with a metallic male component cover member 34 which is disposed abut the main body of the male component. An example of the configuration of the main body of the male component is shown in FIG. 16. In this figure, the main body of the male component 1 is shown connected to the flat cable and in a condition ready to have the metallic male component cover fitted thereon.

Figure 17:
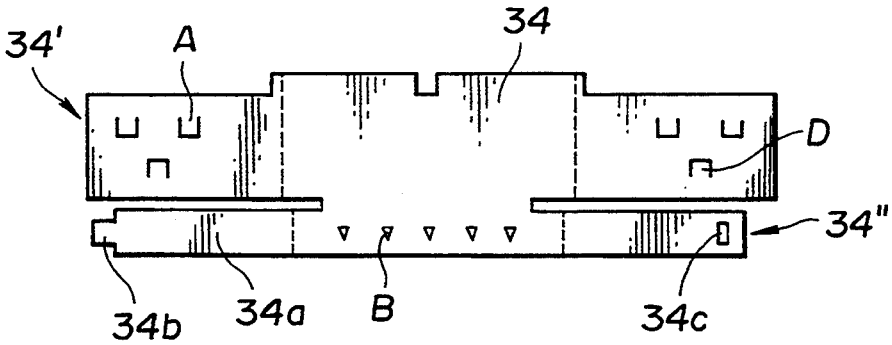
FIG. 17 is a plan view showing the metallic cover in a partially formed state.
Figure 18:
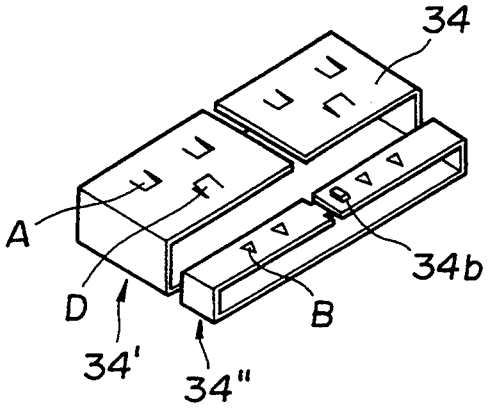
FIG. 18 is a perspective view showing the metallic cover in its completed form.

FIGS. 17 and 18 show the blanked and finished configurations of the metallic male component cover 34 which are used in the instant embodiment. As will be appreciated, the cover 34 is formed of a first portion 34' which is wrapped around the main body of the male component and a second portion 34" which forms a strap-like arrangement 34*a* which is secured about the cable which leads to the male component. A projection 34*b* and an opening 34*c* are formed at the ends of the straps and used to "buckle" the ends together during production.

The cover 34 is formed with three sets of barb-like projections A, D and B. The first set A is used to prevent the cover from being pulled off the main body of the male component in the direction of the cable, the set B is arranged to pierce the outer surface of the sheath 101 and prevent the same from being pulled out while barbs D are used to engage in the recesses 30*a* and secure the cap in place. As shown in FIG. 16 the main body of the male component is formed with a channel-like depression 40 which extends laterally across the upper surface thereof immediately aft of the vertical plate-like electrodes 8. The first set of barb-like projections A are arranged to engage in this depression and prevent the two components from being separated. The combination of the metallic front cover 28 and the metallic male component cover 34 results in a grounding effect which enables the effect of electromagnetic radiation to be shut out.

Further, as will be appreciated, the main body of the male component can suitable formed of a non-conductive plastic or the like, and the other elements quickly and simply stamped out and assembled. In the case of the construction shown in FIG. 8, the stamping of the metallic cover member 28 used at the front of the female housing 2 and the metallic male component cover member 34 used on the male component, reduces costs while ensuring that the effect of electromagnetic noise is shut out by the grounding effect enabled by providing electrical connection between ground and the two metallic members.

What is claimed is:

1. A connector comprising:

a male component having a leading end;

a female housing into which said male component is insertable, said female housing having a rectangular configuration and an elongate opening formed therein through which said male component can be inserted;

a rib which extends into the elongate opening, said rib being arranged to engage in a slot formed in the leading end of said male component;

a resilient member on said male component, said resilient member having first and second ends, the first end being connected to said male component;

a shoulder portion on said resilient member for engagement with a side edge portion of the female housing;

a slide member which is slidably mounted on said male component and arranged to be selectively movable under said resilient member between a first non-locking position and a second locking position wherein flexure of the resilient member inwardly toward the male component is prevented by engagement between said resilient member and said slide member when said slide member is at said second locking position;

a first metallic cover member disposed about the elongate opening of said female housing, said first metallic cover being adapted for connection to an electrical ground, and wherein said male component comprises:

a main body which is operatively connected with a cable; and a second metallic cover, said second metallic cover having a first portion which is adapted to be wrapped about the main body, and a second portion which is adapted to be wrapped about the cable, the first and second metallic covers being arranged to engage one another in a manner which establishes an electrical connection therebetween when the male component is inserted into the female housing.

2. A connector as claimed in claim 1 wherein said male component is formed with a projection which engages the slide member and retains the slide member in the locking position.

3. A connector as claimed in claim 1 wherein said male component is electrically connected with a cable which is covered with a plastic sheath.

4. A connector as claimed in claim 3 wherein said cable is a flat cable.

5. A connector as claimed in claim 1 further comprising a cap which is adapted to enclose a portion of said main body and second metallic cover and further enclose a portion of the cable, said slide member being slidably supported on said cap.

6. A connector comprising:

a male component;

a female housing into which said male component is insertable;

a resilient member on said male component;

a shoulder portion on said resilient member for engagement with a side edge portion of the female housing;

a slide member which is slidably mounted on said male component and arranged to be movable under said resilient member from a non-locking position to a locking position wherein movement of the resilient member in a direction which detaches said shoulder portion from said female housing is prevented when said slide member is at said locking position;

wherein said female housing has a rectangular configuration and comprises an elongate opening formed therein through which said male component can be inserted;

a first metallic cover member disposed about said elongate opening, said metallic cover being adapted for connection to an electrical ground, and wherein said male component comprises:

a main body which is operatively connection with a cable;

a second metallic cover, said second metallic cover having a first portion which is adapted to be wrapped about the main body, and a second portion which is adapted to be wrapped about the cable, the first and second metallic covers being arranged to engage one another in a manner which establishes an electrical connection therebetween when the male component is inserted in to the female housing; and wherein said second metallic cover is formed with first, second and third sets of barbs, the first set of barbs being adapted to engage to a recess formed in said main body, the second set of barbs being adapted to pierce the cover of the cable and the third set of barbs being arranged to engage a cap which is adapted to enclose a portion of said main body, said second metallic cover further enclosing a portion of the cable.

7. A connector comprising:

a male component having a leading end;

a female housing into which said male component is insertable;

a resilient member on said male component;

a shoulder portion on said resilient member for engagement with a side edge portion of the female housing;

a slide member which is slidably mounted on said male component and arranged to be movable under said resilient member from a non-locking position to a locking position wherein movement of the resilient member which detaches said shoulder portion from said female housing is prevented when said slide member is at said locking position;

wherein said female housing has a rectangular configuration including an elongate opening and comprises a rib which extends into the elongate opening, said rib being arranged to engage in a slot formed in the leading end of said male component wherein said male component is electrically connected with a flat cable which is covered with a plastic sheath and is formed with a hollow bridge portion which separates the wires in the flat cable into first and second sections, said hollow bridge portion being provided to allow for the rib.

8. A connector comprising:

a male component having a leading edge;

a female housing into which said male component is insertable;

resilient members on said male component, said resilient members being deflectable to allow insertion of said male component into an opening of said female housing, said resilient members having portions to engage side edge portions of said female housing and prevent extraction of said male component from said female housing when said male component is inserted into said female housing;

a slide member which is disposed on the male component and which can be selectively slid under said resilient members from a non-locking position to a locking position wherein deflection of said resilient member is prevented when said slide member is at said locking position whereby extraction of said male component from said female housing is prevented;

a first pressed metallic cover which is disposed on a mouth of the female housing through which the male component is inserted, the first cover being adapted to be electrically grounded;

a second pressed metallic cover which is disposed about the male component, said second cover engaging the first cover when said male component is inserted into the mouth of said female housing;

a rib formed in the female housing which extends into the opening through which the male component is inserted into the female housing; and a slot formed in the leading edge of said male component for receiving the rib.

* * * * *